US009727005B2

(12) United States Patent
Kuroda

(10) Patent No.: US 9,727,005 B2
(45) Date of Patent: Aug. 8, 2017

(54) SEMICONDUCTIVE ROLLER

(71) Applicant: Sumitomo Rubber Industries, Ltd., Kobe-shi, Hyogo (JP)

(72) Inventor: Kenichi Kuroda, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 43 days.

(21) Appl. No.: 14/807,637

(22) Filed: Jul. 23, 2015

(65) Prior Publication Data

US 2016/0026114 A1 Jan. 28, 2016

(30) Foreign Application Priority Data

Jul. 24, 2014 (JP) ..... 2014-150832

(51) Int. Cl.
*G03G 15/08* (2006.01)

(52) U.S. Cl.
CPC . *G03G 15/0818* (2013.01); *G03G 2215/0634* (2013.01)

(58) Field of Classification Search
CPC ..... G03G 15/0818
USPC ..... 492/18, 30, 37, 59
See application file for complete search history.

(56) References Cited

U.S. PATENT DOCUMENTS 5,185,496 A * 2/1993 Nishimura ..... G03G 15/0928 399/270
5,519,471 A * 5/1996 Nishimura ..... G03G 15/0907 399/284
5,521,683 A * 5/1996 Miyamoto ..... G03G 15/065 399/55
5,565,968 A * 10/1996 Sawa ..... G03G 15/0818 399/286
5,729,805 A * 3/1998 Chiba ..... G03G 9/0821 399/276
6,178,306 B1 * 1/2001 Mizoguchi ..... G03G 15/0928 148/518
6,589,703 B2 * 7/2003 Stelter ..... G03G 9/09708 430/111.3
7,361,442 B2 * 4/2008 Otake ..... G03G 9/0827 399/276

(Continued)

FOREIGN PATENT DOCUMENTS

JP 2000-75632 A 3/2000
JP 2004346988 A * 12/2004 ..... D21H 13/26

(Continued)

*Primary Examiner* — Jason L Vaughan
(74) *Attorney, Agent, or Firm* — Birch, Stewart, Kolasch & Birch, LLP

(57) ABSTRACT

A semiconductive roller is provided, which has a toner transport amount and a toner charge amount properly controlled, particularly, when being used as a developing roller, and is substantially free from imaging failure such as fogging and background smudging. The semiconductive roller is formed from a semiconductive rubber composition, and has an outer peripheral surface having a surface roughness defined by a roughness profile such that an arithmetic average roughness is not greater than 0.7 μm and a difference Rδc between vertical section levels at two different load length percentages (at a load length percentage Rmr1 of 25% and a load length percentage Rmr2 of 75%) is not greater than 1.2 μm.

4 Claims, 1 Drawing Sheet

(56) References Cited

U.S. PATENT DOCUMENTS

| | | | | |
|---|---|---|---|---|
| 7,389,074 | B2 * | 6/2008 | Ebe | G03G 15/0818 399/279 |
| 7,751,770 | B2 * | 7/2010 | Miyamoto | G03G 21/0058 399/343 |
| 7,907,878 | B2 * | 3/2011 | Takagi | G03G 15/0818 399/286 |
| 7,933,533 | B2 * | 4/2011 | Higaki | G03G 15/0225 399/100 |
| 7,935,397 | B2 * | 5/2011 | Okuda | B41M 5/52 347/101 |
| 8,001,895 | B2 * | 8/2011 | Schneider | B41F 7/26 101/350.1 |
| 8,129,014 | B2 * | 3/2012 | Nakamura | G03G 15/0812 399/274 |
| 8,690,310 | B1 * | 4/2014 | Schmaelzle | B41J 2/01 346/138 |
| 9,011,306 | B2 * | 4/2015 | Mizumoto | G03G 15/0818 399/280 |
| 9,274,453 | B2 * | 3/2016 | Oishi | G03G 15/0818 |
| 2012/0014723 | A1 | 1/2012 | Mizumoto et al. | |

FOREIGN PATENT DOCUMENTS

| | | | |
|---|---|---|---|
| JP | 2006-85079 | A | 3/2006 |
| JP | 4595625 | B2 | 12/2010 |
| JP | 2012-78654 | A | 4/2012 |

* cited by examiner

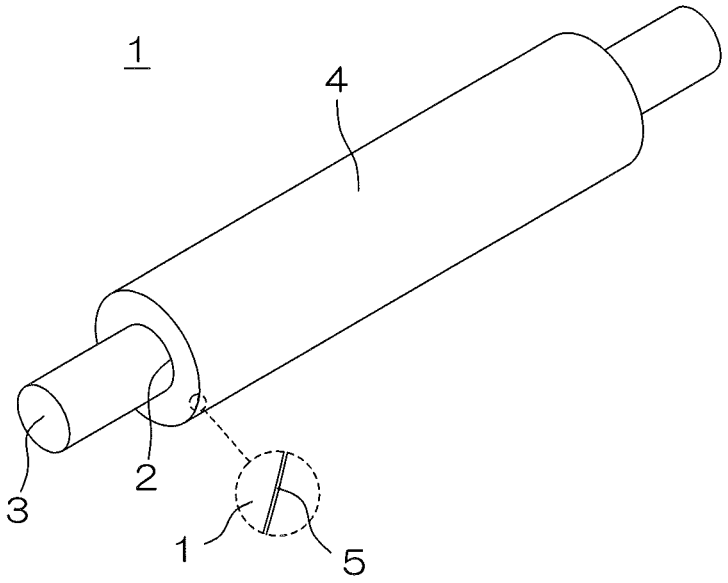
1
4
3
2
1
5

SEMICONDUCTIVE ROLLER

TECHNICAL FIELD

The present invention relates to a semiconductive roller. Particularly, the invention relates to a semiconductive roller to be used as a developing roller.

BACKGROUND ART

In an electrophotographic image forming apparatus such as a laser printer, an electrostatic copying machine, a plain paper facsimile machine or a printer-copier-facsimile multifunction machine, an electrostatic latent image formed on a surface of a photoreceptor drum by electrically charging the photoreceptor surface and exposing the photoreceptor surface to light is developed into a toner image with a toner, and a developing roller is used for the development.

More specifically, the developing roller is rotated with a quantity regulating blade (charging blade) in contact with the developing roller, whereby the toner is electrically charged to be applied to an outer peripheral surface of the developing roller, and the toner application amount is regulated by the quantity regulating blade. Thus, a toner layer is formed to a generally constant thickness on the outer peripheral surface of the developing roller.

In this state, the developing roller is further rotated and, when the toner layer is transported to near the surface of the photoreceptor drum, the toner selectively moves from the toner layer to the surface of the photoreceptor drum according to the electrostatic latent image formed on the surface of the photoreceptor drum. Thus, the electrostatic latent image is developed into the toner image.

There is a trend toward the use of a toner including more uniform, more spherical and smaller size toner particles or a polymeric toner. In order to impart such toner with higher electrical chargeability and efficiently develop the electrostatic latent image into the toner image, it is effective to use, as the developing roller, a semiconductive roller having a roller resistance controlled, for example, at not greater than $10^8\Omega$.

To meet various requirements imposed on the semiconductive roller, the surface geometry of the outer peripheral surface of the semiconductive roller to be kept in contact with the toner is defined, for example, by a ten-point average roughness Rz, an arithmetic average roughness Ra and the like, or by an area ratio of concavities present in the outer peripheral surface (Patent Documents 1 to 4).

CITATION LIST

Patent Documents

Patent Document 1: JP2000-75632A
Patent Document 2: JP2006-85079A
Patent Document 3: JP2012-78654A
Patent Document 4: JP4595625

SUMMARY OF THE INVENTION

Problem to be Solved by the Invention

However, it is impossible to sufficiently satisfy the various requirements for the developing roller simply by defining the surface geometry in the conventional manner.

Particularly, it is preferred to increase the surface roughness of the outer peripheral surface of the developing roller as defined in the conventional manner in order to impart the developing roller with higher toner transportability. Where the outer peripheral surface of the developing roller has a greater surface roughness, however, the developing roller is liable to suffer from toner charging failure and imaging failure such as fogging and background smudging.

It is an object of the present invention to provide a semiconductive roller which has a toner transport amount and a toner charge amount properly controlled, particularly, when being used as a developing roller, and is substantially free from imaging failure such as fogging and background smudging.

Solution to Problem

The present invention provides a semiconductive roller which is formed from a semiconductive rubber composition, and has an outer peripheral surface having a surface roughness defined by a roughness profile such that an arithmetic average roughness is not greater than 0.7 μM and a profile section height difference (Rδc) between vertical section levels at two different load length percentages (at a load length percentage Rmr1 of 25% and a load length percentage Rmr2 of 75%) is not greater than 1.2 μm.

Effects of the Invention

According to the present invention, as described above, the arithmetic average roughness Ra of the roughness profile of the outer peripheral surface of the semiconductive roller which indicates an average vertical amplitude is not greater than 0.7 μm. Thus, the surface roughness of the outer peripheral surface is substantially prevented from being excessively increased, thereby suppressing the toner charging failure and the imaging failure such as the fogging and the background smudging due to the toner charging failure.

In addition, the difference Rδc between the vertical section levels at the two different load length percentages (at a load length percentage Rmr1 of 25% and a load length percentage Rmr2 of 75%) of the roughness profile is not greater than 1.2 μm. Thus, the total area of concavities opening in the outer peripheral surface is increased, thereby imparting the semiconductive roller with higher toner transportability.

According to the present invention, therefore, the semiconductive roller has a toner transport amount and a toner charge amount properly controlled, particularly, for use as the developing roller, and is substantially free from the imaging failure such as the fogging and the background smudging.

BRIEF DESCRIPTION OF THE DRAWING

The FIGURE is a perspective view illustrating an exemplary semiconductive roller according to an embodiment of the present invention.

EMBODIMENTS OF THE INVENTION

<<Semiconductive Roller>>

As shown in the FIGURE, a semiconductive roller 1 according to an embodiment of the present invention is a nonporous tubular body formed from a semiconductive rubber composition as having a single-layer structure, and a shaft 3 is inserted into and fixed to a center through-hole 2 of the tubular body.

The shaft 3 is a unitary member, for example, made of a metal such as aluminum, an aluminum alloy or a stainless steel.

The shaft 3 is electrically connected to and mechanically fixed to the semiconductive roller 1, for example, via an electrically conductive adhesive agent. Alternatively, a shaft having an outer diameter that is greater than the inner diameter of the through-hole 2 is used as the shaft 3, and press-inserted into the through-hole 2 to be electrically connected to and mechanically fixed to the semiconductive roller 1. Thus, the shaft 3 and the semiconductive roller 1 are unitarily rotatable.

As shown in the FIGURE on an enlarged scale, an oxide film 5 may be provided on an outer peripheral surface 4 of the semiconductive roller 1.

The oxide film 5 thus provided functions as a dielectric layer to reduce the dielectric dissipation factor of the semiconductive roller 1. Where the semiconductive roller 1 is used as the developing roller, the oxide film 5 serves as a lower friction layer to suppress adhesion of toner.

In addition, the oxide film 5 can be easily formed, for example, by irradiation with ultraviolet radiation in an oxidizing atmosphere, thereby suppressing the reduction in the productivity of the semiconductive roller 1 and the increase in production costs. However, the oxide film 5 may be obviated.

In the present invention, the outer peripheral surface 4 of the semiconductive roller 1 is defined by a roughness profile such that an arithmetic average roughness Ra is not greater than 0.7 μm and a difference Rδc between vertical section levels at the two different load length percentages (at a load length percentage Rmr1 of 25% and a load length percentage Rmr2 of 75%) is not greater than 1.2 μm.

As described above, the arithmetic average roughness Ra of the roughness profile of the outer peripheral surface of the semiconductive roller, which indicates an average vertical amplitude, is not greater than 0.7 μm. Thus, the surface roughness of the outer peripheral surface is substantially prevented from being excessively increased, thereby suppressing the toner charging failure and the imaging failure such as the fogging and the background smudging due to the toner charging failure.

In addition, the difference Rδc between vertical section levels at the two different load length percentages (at a load length percentage Rmr1 of 25% and a load length percentage Rmr2 of 75%) of the roughness profile is not greater than 1.2 μm. Thus, the total area of concavities opening in the outer peripheral surface is increased, thereby imparting the semiconductive roller with higher toner transportability.

Thus, the semiconductive roller has a toner transport amount and a toner charge amount properly controlled, particularly, for use as a developing roller, and is substantially free from the imaging failure such as the fogging and the background smudging.

In order to further reliably suppress the toner charging failure and the imaging failure such as the fogging and the background smudging due to the toner charging failure, the arithmetic average roughness Ra of the roughness profile of the outer peripheral surface 4 of the semiconductive roller 1 is more preferably not greater than 0.6 μm in the aforementioned range.

If the arithmetic average roughness Ra is excessively small, the outer peripheral surface 4 of the semiconductive roller 1 is excessively smooth. Therefore, even if the section level difference Rδc falls within the aforementioned range, it will be impossible to impart the developing roller with higher toner transportability. In order to impart the semiconductive roller 1 with further higher toner transportability, the arithmetic average roughness Ra is particularly preferably not less than 0.3 μm in the aforementioned range.

For further improvement of the toner transportability, the difference Rδc between the vertical section levels at the two different load length percentages (at a load length percentage Rmr1 of 25% and a load length percentage Rmr2 of 75%) of the roughness profile is particularly preferably not greater than 1.0 μm in the aforementioned range.

If the section level difference Rδc is excessively small, projections defined between the concavities in the outer peripheral surface 4 of the semiconductive roller 1 each have an excessively small size. Therefore, when the semiconductive roller 1 is repeatedly used as the developing roller, the projections are liable to wear in a relatively short period. Thus, the semiconductive roller 1 is liable to have a smoother surface and hence a significantly reduced toner transportability. In order to allow the semiconductive roller 1 to maintain the higher toner transportability for a longer period of time, the section level difference Rδc is particularly preferably not less than 0.5 μm in the aforementioned range.

In the present invention, the arithmetic average roughness Ra and the section level difference Rδc of the roughness profile are determined in conformity with Japanese Industrial Standards JIS B0601:2013 "Geometrical Product Specifications (GPS)—Surface texture: Profile method—Terms, definitions and surface texture parameters."

The semiconductive roller 1 is produced by first extruding a predetermined semiconductive rubber composition into a tubular body by means of an extruder, and then crosslinking the tubular body in a vulcanization can by pressure and heat.

The crosslinked tubular body is heated in an oven or the like for secondary crosslinking, then cooled, cut to a predetermined length, and polished to a predetermined outer diameter.

The shaft 3 may be inserted into and fixed to the through-hole 2 at any time between the end of the crosslinking and the end of the polishing.

However, a process sequence from the secondary crosslinking to the polishing is preferably performed with the shaft 3 inserted through the through-hole 2 after the primary crosslinking. This prevents warpage and deformation of the semiconductive roller 1 which may otherwise occur due to expansion and contraction of the semi conductive roller 1 during the secondary crosslinking. The outer peripheral surface 4 of the semiconductive roller 1 is polished, while the semiconductive roller 1 is rotated about the shaft 3. This improves the working efficiency in the polishing, and suppresses deflection of the outer peripheral surface 4.

As previously described, the shaft 3 having an outer diameter greater than the inner diameter of the through-hole 2 may be press-inserted into the through-hole 2, or the shaft 3 may be inserted through the through-hole 2 of the tubular body with the intervention of an electrically conductive thermosetting adhesive agent before the secondary crosslinking.

In the latter case, the thermosetting adhesive agent is cured when the tubular body is secondarily crosslinked by the heating in the oven. Thus, the shaft 3 is electrically connected to and mechanically fixed to the semiconductive roller 1.

In the former case, the electrical connection and the mechanical fixing are achieved simultaneously with the press insertion.

In the polishing step, the outer diameter and the surface geometry of the semiconductive roller 1 are controlled in the conventional manner by rough polishing such as a dry traverse polishing method.

Then, the outer peripheral surface 4 is mirror-polished by a wet traverse polishing method.

With the use of a very fine abrasive material, the outer peripheral surface 4 is mirror-polished as having a roughness profile such that the arithmetic average roughness Ra is not greater than 0.7 μm and the difference Rδc between the vertical section levels at the two different load length percentages (at a load length percentage Rmr1 of 25% and a load length percentage Rmr2 of 75%) is not greater than 1.2 μm.

Where a #1000 or #2000 wrapping film sheet rather than #800 or #1000 water-resistant polishing paper is used as the abrasive material, for example, the roughness profile of the outer peripheral surface 4 can be controlled as having an arithmetic average roughness Ra of not greater than 0.7 μm and a section level difference Rδc of not greater than 1.2 μm. As the #-number of the wrapping film sheet is increased (as the particle size of the abrasive material is reduced), the arithmetic average roughness Ra and the section level difference Rδc are reduced in the aforementioned ranges.

As described above, the formation of the oxide film 5 is preferably achieved by the irradiation of the outer peripheral surface 4 of the semiconductive roller 1 with the ultraviolet radiation, because this method is simple and efficient. That is, the formation of the oxide film 5 is achieved by irradiating a part of the semiconductive rubber composition present in the outer peripheral surface 4 of the semiconductive roller 1 with ultraviolet radiation having a predetermined wavelength for a predetermined period to oxidize the irradiated part of the semiconductive rubber composition.

Since the formation of the oxide film 5 is achieved through the oxidation of the part of the semiconductive rubber composition present in the outer peripheral surface 4 of the semiconductive roller 1 by the irradiation with the ultraviolet radiation, the resulting oxide film 5 is free from the problems associated with a coating film formed in a conventional manner by applying a coating agent, and highly uniform in thickness and surface geometry.

The wavelength of the ultraviolet radiation to be used for the irradiation is preferably not less than 100 nm and not greater than 400 nm, particularly preferably not greater than 300 nm, for efficient oxidation of the semiconductive rubber composition and for the formation of the oxide film 5 excellent in the aforementioned functions. The irradiation period is preferably not shorter than 30 seconds and not longer than 30 minutes, particularly preferably not shorter than 1 minute and not longer than 15 minutes.

The formation of the oxide film 5 may be achieved by other method, or may be obviated in some case.

The semiconductive roller 1 having the nonporous single-layer structure preferably has a Shore-A hardness of not greater than 60, particularly preferably not greater than 50.

If the Shore-A hardness is greater than the aforementioned range, the semiconductive roller 1 has an insufficient flexibility, thereby failing to sufficiently provide the effect of providing a greater nip width to improve the toner developing efficiency and the effect of reducing the damage to the toner to improve the imaging durability.

In the present invention, the Shore-A hardness is determined at a temperature of 23° C. with a load of 1000 g applied to opposite ends in conformity with Japanese Industrial Standards JIS K6253-3$_{:2012}$.

The semiconductive roller 1 preferably has a roller resistance R of not less than $10^4\Omega$ and not greater than $10^8\Omega$, as described above, particularly preferably not less than $10^{6.5}\Omega$, as measured with an application voltage of 1000 V in an ordinary temperature and ordinary humidity environment at a temperature of 23° C. at a relative humidity of 55%.

If the semiconductive roller 1 is a lower-resistance semiconductive roller having a roller resistance R of less than the aforementioned range, the semiconductive roller 1 is liable to leak the charge of the toner when being used as the developing roller. Therefore, if the charge is leaked along a surface of a formed image, for example, the formed image is liable to have a reduced resolution.

If the semiconductive roller 1 is a higher-resistance semiconductive roller having a roller resistance R of greater than the aforementioned range, the semiconductive roller 1 fails to form an image having a sufficient image density.

The inventive semiconductive roller is not limited to the single-layer semiconductive roller 1 having a single-layer structure (excluding the oxide film 5), but may have a multi-layer structure including two rubber layers, i.e., an outer layer provided adjacent the outer peripheral surface 4 and an inner layer provided adjacent the shaft 3.

The inventive semiconductive roller can be advantageously used as a developing roller, particularly, in an image forming apparatus, such as a laser printer, an electrostatic copying machine, a plain paper facsimile machine or a printer-copier-facsimile multifunction machine, using a non-magnetic positively-chargeable single-component toner.

The inventive semiconductive roller may be used not only as the developing roller but also as a charging roller, a transfer roller or a cleaning roller in any of various electrophotographic image forming apparatuses.

<<Semiconductive Rubber Composition>>

Any of various rubber compositions which are capable of imparting the semiconductive roller 1 with a semiconductive property (i.e., a roller resistance of not greater than about $10^8\Omega$) may be used as the semiconductive rubber composition for the semiconductive roller 1.

Particularly, the semiconductive rubber composition preferably contains an ion conductive rubber such as an epichlorohydrin rubber to be thereby imparted with an ion conductivity.

The semiconductive rubber composition may contain, for example, a rubber component including the epichlorohydrin rubber and an additional rubber, and a crosslinking component for crosslinking the rubber component in predetermined proportions.

<Epichlorohydrin Rubber>

Examples of the epichlorohydrin rubber for the rubber component include epichlorohydrin homopolymers, epichlorohydrin-ethylene oxide bipolymers (ECO), epichlorohydrin-propylene oxide bipolymers, epichlorohydrin-allyl glycidyl ether bipolymers, epichlorohydrin-ethylene oxide-allyl glycidyl ether terpolymers (GECO), epichlorohydrin-propylene oxide-allyl glycidyl ether terpolymers and epichlorohydrin-ethylene oxide-propylene oxide-allyl glycidyl ether quaterpolymers, which may be used either alone or in combination.

Of these epichlorohydrin rubbers, the ethylene oxide-containing copolymers, particularly the ECO and/or the GECO are preferred.

These copolymers preferably each have an ethylene oxide content of not less than 30 mol % and not greater than 80 mol %, particularly preferably not less than 50 mol %.

Ethylene oxide functions to reduce the overall roller resistance of the semiconductive roller. If the ethylene oxide content is less than the aforementioned range, however, it will be impossible to sufficiently provide this function and hence to sufficiently reduce the roller resistance of the semiconductive roller.

If the ethylene oxide content is greater than the aforementioned range, on the other hand, ethylene oxide is liable to be crystallized, whereby the segment motion of molecular chains is hindered to adversely increase the roller resistance of the semiconductive roller. Further, the semiconductive roller is liable to have an excessively high hardness after the crosslinking, and the semiconductive rubber composition is liable to have a higher viscosity when being heat-melted before the crosslinking.

The ECO has an epichlorohydrin content that is a balance obtained by subtracting the ethylene oxide content from the total. That is, the epichlorohydrin content is preferably not less than 20 mol % and not greater than 70 mol %, particularly preferably not greater than 50 mol %.

The GECO preferably has an allyl glycidyl ether content of not less than 0.5 mol % and not greater than 10 mol %, particularly preferably not less than 2 mol % and not greater than 5 mol %.

Allyl glycidyl ether per se functions as side chains of the copolymer to provide a free volume, whereby the crystallization of ethylene oxide is suppressed to reduce the roller resistance of the semiconductive roller. However, if the allyl glycidyl ether content is less than the aforementioned range, it will be impossible to provide this function and hence to sufficiently reduce the roller resistance of the semiconductive roller.

Allyl glycidyl ether also functions as crosslinking sites during the crosslinking of the GECO. Therefore, if the allyl glycidyl ether content is greater than the aforementioned range, the crosslinking density of the GECO is increased, whereby the segment motion of molecular chains is hindered. This may adversely increase the roller resistance of the semiconductive roller.

The GECO has an epichlorohydrin content that is a balance obtained by subtracting the ethylene oxide content and the allyl glycidyl ether content from the total. That is, the epichlorohydrin content is preferably not less than 10 mol % and not greater than 69.5 mol %, particularly preferably not less than 19.5 mol % and not greater than 60 mol %.

Examples of the GECO include copolymers of the three comonomers described above in a narrow sense, as well as known modification products obtained by modifying an epichlorohydrin-ethylene oxide copolymer (ECO) with allyl glycidyl ether. In the present invention, any of these modification products may be used as the GECO.

The proportion of the epichlorohydrin rubber to be blended is preferably not less than 5 parts by mass and not greater than 40 parts by mass, particularly preferably not less than 10 parts by mass and not greater than 30 parts by mass, based on 100 parts by mass of the overall rubber component.

<Additional Rubber>

At least one selected from the group consisting of a styrene butadiene rubber (SBR), a chloroprene rubber (CR), an acrylonitrile butadiene rubber (NBR), a butadiene rubber (BR), an acryl rubber (ACM) and an ethylene propylene diene rubber (EPDM) may be used as an additional rubber.

(SBR)

Usable as the SBR are various SBRs synthesized by copolymerizing styrene and 1,3-butadiene by an emulsion polymerization method, a solution polymerization method and other various polymerization methods. The SBRs include those of an oil-extension type having flexibility controlled by addition of an extension oil, and those of a non-oil-extension type containing no extension oil. Either type of SBRs is usable.

According to the styrene content, the SBRs are classified into a higher styrene content type, an intermediate styrene content type and a lower styrene content type, and any of these types of SBRs is usable.

These SBRs may be used either alone or in combination.

(CR)

The CR is synthesized, for example, by polymerizing chloroprene by an emulsion polymerization method. The CR is classified in a sulfur modification type or a non-sulfur-modification type depending on the type of a molecular weight adjusting agent to be used for the emulsion polymerization. Either type of CRs is usable in the present invention.

The sulfur modification type CR is prepared by plasticizing a copolymer of chloroprene and sulfur (molecular weight adjusting agent) with thiuram disulfide or the like to adjust the viscosity of the copolymer to a predetermined viscosity level.

The non-sulfur-modification type CR is classified, for example, in a mercaptan modification type, a xanthogen modification type or the like.

The mercaptan modification type CR is synthesized in substantially the same manner as the sulfur modification type CR, except that an alkyl mercaptan such as n-dodecyl mercaptan, tert-dodecyl mercaptan or octyl mercaptan, for example, is used as the molecular weight adjusting agent. The xanthogen modification type CR is synthesized in substantially the same manner as the sulfur modification type CR, except that an alkyl xanthogen compound is used as the molecular weight adjusting agent.

Further, the CR is classified in a lower crystallization speed type, an intermediate crystallization speed type or a higher crystallization speed type depending on the crystallization speed.

In the present invention, any of these types of CRs may be used. Particularly, CRs of the non-sulfur-modification type and the lower crystallization speed type are preferably used either alone or in combination.

Further, a rubber of a copolymer of chloroprene and other comonomer may be used as the CR.

Examples of the other comonomer include 2,3-dichloro-1,3-butadiene, 1-chloro-1,3-butadiene, styrene, acrylonitrile, methacrylonitrile, isoprene, butadiene, acrylic acid, acrylates, methacrylic acid and methacrylates, which may be used either alone or in combination.

(NBR)

The NBR is classified in a lower acrylonitrile content type, an intermediate acrylonitrile content type, an intermediate to higher acrylonitrile content type, a higher acrylonitrile content type or a very high acrylonitrile content type depending on the acrylonitrile content. Any of these types of NBRs is usable.

The NBRs include those of an oil-extension type having flexibility controlled by addition of an extension oil, and those of a non-oil-extension type containing no extension oil. Either type of NBRs is usable.

These NBRs may be used either alone or in combination.

(BR)

Usable as the BR are various crosslinkable BRs.

Particularly, a higher cis-content BR having a cis-1,4 bond content of not less than 95% and having excellent lower-temperature characteristic properties and a lower hardness and hence a higher flexibility at a lower temperature at a lower humidity is preferred.

The BRs include those of an oil-extension type having flexibility controlled by addition of an extension oil, and those of a non-oil-extension type containing no extension oil. Either type of BRs is usable.

These BRs may be used either alone or in combination.

(ACM)

Usable as the ACM are various ACMs each synthesized by copolymerizing an alkyl acrylate such as ethyl acrylate or butyl acrylate as a major component with acrylonitrile, a halogen-containing monomer such as 2-chloroethyl vinyl ether, or glycidyl acrylate, allyl glycidyl ether, ethylidene norbornene or the like.

These ACMs may be used either alone or in combination.

(EPDM)

Usable as the EPDM are various EPDMs each prepared by introducing double bonds into a main chain thereof by employing a small amount of a third ingredient (diene) in addition to ethylene and propylene. A variety of EPDM products containing different types of third ingredients in different amounts are commercially available. Typical examples of the third ingredients include ethylidene norbornene (ENB), 1,4-hexadiene (1,4-HD) and dicyclopentadiene (DCP). A Ziegler catalyst is typically used as a polymerization catalyst.

The EPDMs include those of an oil-extension type having flexibility controlled by addition of an extension oil, and those of a non-oil-extension type containing no extension oil. Either type of EPDMs is usable.

These EPDMs may be used either alone or in combination.

(Blending Proportion)

A combination of the CR and the SBR or a combination of the CR and the BR is particularly preferred as the additional rubber for the rubber component.

As described above, the CR functions to finely control the roller resistance of the semiconductive roller as well as to finely control the toner charge amount and the toner transport amount when the semiconductive roller is used as the developing roller. In addition, the CR functions to increase the flexibility of the semiconductive roller to improve the toner imaging durability.

The proportion of the CR to be blended is preferably not less than 1 part by mass and not greater than 30 parts by mass, particularly preferably not less than 5 parts by mass and not greater than 20 parts by mass, based on 100 parts by mass of the overall rubber component.

If the proportion of the CR is less than the aforementioned range, it will be impossible to sufficiently provide the effect of the addition of the CR described above.

If the proportion of the CR is greater than the aforementioned range, on the other hand, the proportion of the epichlorohydrin rubber is relatively reduced to increase the roller resistance. Therefore, the semiconductive roller is liable to have a reduced toner charge amount and a reduced toner transport amount when being used as the developing roller.

The proportion of the SBR or the BR to be blended is a balance obtained by subtracting the proportions of the epichlorohydrin rubber and the CR from the total. That is, the proportion of the SBR or the BR to be blended is not less than 30 parts by mass and not greater than 94 parts by mass, particularly preferably not less than 50 parts by mass and not greater than 85 parts by mass, based on 100 parts by mass of the overall rubber component.

<Crosslinking Component>

The crosslinking component includes a crosslinking agent, an accelerating agent, an acceleration assisting agent, and the like.

Examples of the crosslinking agent include a sulfur crosslinking agent, a thiourea crosslinking agent, a triazine derivative crosslinking agent, a peroxide crosslinking agent and monomers, which may be used either alone or in combination.

Examples of the sulfur crosslinking agent include sulfur such as sulfur powder and organic sulfur-containing compounds. Examples of the organic sulfur-containing compounds include tetramethylthiuram disulfide and N,N-dithiobismorpholine.

Examples of the thiourea crosslinking agent include tetramethylthiourea, trimethylthiourea, ethylene thiourea, and thioureas represented by $(C_nH_{2n+1}NH)_2C{=}S$ (wherein n is an integer of 1 to 10), which may be used either alone or in combination.

Examples of the peroxide crosslinking agent include benzoyl peroxide and the like.

The sulfur and the thiourea crosslinking agent are preferably used in combination as the crosslinking agent.

The proportion of the sulfur to be used in combination with the thiourea crosslinking agent is preferably not less than 0.2 parts by mass and not greater than 3 parts by mass, particularly preferably not less than 0.5 parts by mass and not greater than 2 parts by mass, based on 100 parts by mass of the overall rubber component.

The proportion of the thiourea crosslinking agent to be blended is preferably not less than 0.2 parts by mass and not greater than 3 parts by mass, particularly preferably not less than 0.3 parts by mass and not greater than 1 part by mass, based on 100 parts by mass of the overall rubber component.

Examples of the accelerating agent include inorganic accelerating agents such as lime, magnesia (MgO) and litharge (PbO), and organic accelerating agents, which may be used either alone or in combination.

Examples of the organic accelerating agents include: guanidine accelerating agents such as 1,3-di-o-tolylguanidine, 1,3-diphenylguanidine, 1-o-tolylbiguanide and a di-o-tolylguanidine salt of dicatechol borate; thiazole accelerating agents such as 2-mercaptobenzothiazole and di-2-benzothiazolyl disulfide; sulfenamide accelerating agents such as N-cyclohexyl-2-benzothiazylsulfenamide; thiuram accelerating agents such as tetramethylthiuram monosulfide, tetramethylthiuram disulfide, tetraethylthiuram disulfide and dipentamethylenethiuram tetrasulfide; and thiourea accelerating agents, which may be used either alone or in combination.

Different types of accelerating agents have different functions and, therefore, are preferably used in combination.

The proportion of the accelerating agent to be blended may be properly determined depending on the type of the accelerating agent, but is preferably not less than 0.1 part by mass and not greater than 5 parts by mass, particularly preferably not less than 0.2 parts by mass and not greater than 2 parts by mass, based on 100 parts by mass of the overall rubber component.

Examples of the acceleration assisting agent include: metal compounds such as zinc white (zinc oxide); fatty acids such as stearic acid, oleic acid and cotton seed fatty acids; and other conventionally known acceleration assisting agents, which may be used either alone or in combination.

The proportion of the acceleration assisting agent to be blended is preferably not less than 0.1 part by mass and not greater than 7 parts by mass, particularly preferably not less than 0.5 parts by mass and not greater than 5 parts by mass, based on 100 parts by mass of the overall rubber component.

<Other Ingredients>

As required, various additives may be added to the semiconductive rubber composition. Examples of the additives include an acid accepting agent, a plasticizing agent, a processing aid, a degradation preventing agent, a filler, an anti-scorching agent, a lubricant, a pigment, an anti-static agent, a flame retarder, a neutralizing agent, a nucleating agent, a co-crosslinking agent and the like.

In the presence of the acid accepting agent, chlorine-containing gases generated from the epichlorohydrin rubber and the CR during the crosslinking of the rubber component are prevented from remaining in the semiconductive roller. Thus, the acid accepting agent functions to prevent the inhibition of the crosslinking and the contamination of the photoreceptor body, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where the hydrotalcites are used in combination with magnesium oxide or potassium oxide, a higher acid accepting effect can be provided, thereby more reliably preventing the contamination of the photoreceptor body.

The proportion of the acid accepting agent to be blended is preferably not less than 0.5 parts by mass and not greater than 6 parts by mass, particularly preferably not less than 1 part by mass and not greater than 4 parts by mass, based on 100 parts by mass of the overall rubber component.

Examples of the plasticizing agent include plasticizers such as dibutyl phthalate (DBP), dioctyl phthalate (DOP) and tricresyl phosphate, and waxes such as polar waxes. Examples of the processing aid include fatty acids such as stearic acid.

The proportion of the plasticizing agent and/or the processing aid to be blended is preferably not greater than 5 parts by mass based on 100 parts by mass of the overall rubber component. This prevents the contamination of the photoreceptor body, for example, when the semiconductive roller is mounted in the image forming apparatus or when the image forming apparatus is operated. For this purpose, it is particularly preferred to use any of the polar waxes out of the plasticizing agents.

Examples of the degradation preventing agent include various anti-aging agents and anti-oxidants.

The anti-oxidants serve to reduce the environmental dependence of the roller resistance of the semiconductive roller and to suppress the increase in roller resistance during continuous energization of the semiconductive roller. Examples of the anti-oxidants include nickel diethyldithiocarbamate (NOCRAC (registered trade name) NEC-P available from Ouchi Shinko Chemical Industrial Co., Ltd.) and nickel dibutyldithiocarbamate (NOCRAC NBC available from Ouchi Shinko Chemical Industrial Co., Ltd.)

Examples of the filler include zinc oxide, silica, carbon, carbon black, clay, talc, calcium carbonate, magnesium carbonate and aluminum hydroxide, which may be used either alone or in combination.

The mechanical strength and the like of the semiconductive roller can be improved by blending the filler.

The proportion of the filler to be blended is preferably not less than 5 parts by mass and not greater than 25 parts by mass, particularly preferably not greater than 20 parts by mass, based on 100 parts by mass of the overall rubber component.

An electrically conductive filler such as electrically conductive carbon black may be blended as the filler to impart the semiconductive roller with electron conductivity.

A particularly preferred example of the electrically conductive carbon black is a particulate electrically conductive carbon black including primary particles which have an average particle diameter of not less than about 25 nm and not greater than about 45 nm and are agglomerated at a bulk density of not less than about 0.2 g/ml and not greater than about 0.4 g/ml.

The electrically conductive carbon black particles are easily removed in a particulate form from the outer peripheral surface by primary and secondary mirror-polishing steps, and the surface geometry of the outer peripheral surface 4 is formed by the removal of the particles as having a roughness profile such that the arithmetic average roughness Ra is not greater than 0.7 μm and the difference Rδc between the vertical section levels at the two different load length percentages (at a load length percentage Rmr1 of 25% and a load length percentage Rmr2 of 75%) is not greater than 1.2 μm.

An example of the particulate electrically conductive carbon black is DENKA BLACK (registered trade name) available from Denki Kagaku Kogyo K.K. and having an average particle diameter of 35 nm, a specific surface area of 69 $m^2/g$, an iodine adsorption amount of 93 mg/g and a bulk density of 0.25 g/ml.

In order to form the aforementioned surface geometry in the outer peripheral surface 4 by the removal of the electrically conductive carbon black particles during the mirror-polishing steps and to control the roller resistance of the semiconductive roller 1 in the aforementioned range, the proportion of the particulate electrically conductive carbon black is preferably not less than 10 parts by mass and not greater than 30 parts by mass, particularly preferably not less than 15 parts by mass and not greater than 25 parts by mass, based on 100 parts by mass of the overall rubber component.

Examples of the anti-scorching agent include N-cyclohexylthiophthalimide, phthalic anhydride, N-nitrosodiphenylamine and 2,4-diphenyl-4-metyl-1-pentene, which may be used either alone or in combination. Particularly, N-cyclohexylthiophthalimide is preferred.

The proportion of the anti-scorching agent to be blended is preferably not less than 0.1 part by mass and not greater than 5 parts by mass, particularly preferably not greater than 1 part by mass, based on 100 parts by mass of the overall rubber component.

The co-crosslinking agent serves to crosslink itself as well as the rubber component to increase the overall molecular weight.

Examples of the co-crosslinking agent include ethylenically unsaturated monomers typified by methacrylic esters, metal salts of methacrylic acid and acrylic acid, polyfunctional polymers utilizing functional groups of 1,2-polybutadienes, and dioximes, which may be used either alone or in combination.

Examples of the ethylenically unsaturated monomers include:

(a) monocarboxylic acids such as acrylic acid, methacrylic acid and crotonic acid;

(b) dicarboxylic acids such as maleic acid, fumaric acid and itaconic acid;

(c) esters and anhydrides of the unsaturated carboxylic acids (a) and (b);

(d) metal salts of the monomers (a) to (c);

(e) aliphatic conjugated dienes such as 1,3-butadiene, isoprene and 2-chloro-1,3-butadiene;

(f) aromatic vinyl compounds such as styrene, α-methylstyrene, vinyltoluene, ethylvinylbenzene and divinylbenzene;

(g) vinyl compounds such as triallyl isocyanurate, triallyl cyanurate and vinylpyridine each having a hetero ring; and (h) cyanovinyl compounds such as (meth)acrylonitrile and α-chloroacrylonitrile, acrolein, formyl sterol, vinyl methyl ketone, vinyl ethyl ketone and vinyl butyl ketone. These ethylenically unsaturated monomers may be used either alone or in combination.

Monocarboxylic acid esters are preferred as the esters (c) of the unsaturated carboxylic acids.

Specific examples of the monocarboxylic acid esters include:

alkyl(meth)acrylates such as methyl(meth)acrylate, ethyl (meth)acrylate, n-propyl(meth)acrylate, i-propyl(meth)acrylate, n-butyl(meth)acrylate, i-butyl(meth)acrylate, n-pentyl (meth)acrylate, i-pentyl(meth)acrylate, n-hexyl(meth) acrylate, cyclohexyl(meth)acrylate, 2-ethylhexyl(meth) acrylate, octyl(meth)acrylate, i-nonyl(meth)acrylate, tert-butylcyclohexyl(meth)acrylate, decyl(meth)acrylate, dodecyl (meth)acrylate, hydroxymethyl(meth)acrylate and hydroxyethyl(meth)acrylate;

aminoalkyl(meth)acrylates such as aminoethyl(meth) acrylate, dimethylaminoethyl (meth)acrylate and butylaminoethyl(meth)acrylate;

(meth)acrylates such as benzyl(meth)acrylate, benzoyl (meth)acrylate and aryl(meth)acrylates each having an aromatic ring;

(meth)acrylates such as glycidyl(meth)acrylate, methaglycidyl(meth)acrylate and epoxycyclohexyl(meth)acrylate each having an epoxy group;

(meth)acrylates such as N-methylol(meth)acrylamide, γ-(meth)acryloxypropyltrimethoxysilane and tetrahydrofurfuryl methacrylate each having a functional group; and polyfunctional(meth)acrylates such as ethylene glycol di(meth)acrylate, trimethylolpropane tri(meth)acrylate, ethylene dimethacrylate (EDMA), polyethylene glycol dimethacrylate and isobutylene ethylene dimethacrylate. These monocarboxylic acid esters may be used either alone or in combination.

The semiconductive rubber composition containing the ingredients described above can be prepared in a conventional manner. First, the rubbers for the rubber component are blended in the predetermined proportions, and the resulting rubber component is simply kneaded. After additives other than the crosslinking component are added to and kneaded with the rubber component, the crosslinking component is finally added to and further kneaded with the resulting mixture. Thus, the semiconductive rubber composition is provided. A kneader, a Banbury mixer, an extruder or the like, for example, is usable for the kneading.

EXAMPLES

Example 1

(Preparation of Semiconductive Rubber Composition)

A rubber component was prepared by blending 20 parts by mass of a GECO (EPION (registered trade name) 301 available from Daiso Co., Ltd. and having a molar ratio of EO/EP/AGE=73/23/4), 10 parts by mass of a CR (SHOPRENE (registered trade name) WRT available from Showa Denko K.K.) and 70 parts by mass of an SBR (non-oil-extension type JSR1502 available from JSR Co., Ltd. and having a styrene content of 23.5%).

While 100 parts by mass of the rubber component was simply kneaded by means of a Banbury mixer, ingredients shown below in Table 1 except the crosslinking component were added to the rubber component. After the resulting mixture was further kneaded, the crosslinking component was added to and further kneaded with the mixture. Thus, a rubber composition was prepared.

TABLE 1

| Ingredients | Parts by mass |
|---|---|
| 5% Oil-containing sulfur | 1.05 |
| Thiourea crosslinking agent | 0.33 |
| Accelerating agent DM | 1.50 |
| Accelerating agent TS | 0.50 |
| Accelerating agent DT | 0.28 |
| Zinc oxide type-2 | 5.00 |
| Acid accepting agent | 3.00 |
| Electrically conductive carbon black | 20.0 |

The ingredients shown in Table 1 are as follows. The amounts (parts by mass) shown in Table 1 are based on 100 parts by mass of the overall rubber component. 5% Oil-containing sulfur: Crosslinking agent (available from Tsurumi Chemical Industry Co., Ltd.)

Thiourea crosslinking agent: Ethylene thiourea (2-mercaptoimidazoline ACCEL (registered trade name) 22-S available from Kawaguchi Chemical Industry Co., Ltd. Accelerating agent DM: Di-2-benzothiazlyl disulfide (SUNSINE MBTS (trade name) available from Shandong Shanxian Chemical Co., Ltd.)

Accelerating agent TS: Tetramethylthiuram monosulfide (thiuram accelerating agent SANCELER (registered trade name) TS available from Sanshin Chemical Industry Co., Ltd.)

Accelerating agent DT: 1,3-di-o-tolylguanidine (guanidine accelerating agent SANCELER DT available from Sanshin Chemical Industry Co., Ltd.)

Zinc oxide Type-2: Acceleration assisting agent (available from Mitsui Mining & Smelting Co., Ltd.) Acid accepting agent: Hydrotalcites (DHT-4A (registered trade name) 2 available from Kyowa Chemical Industry Co., Ltd.)

Electrically conductive carbon black: Particulate electrically conductive carbon black (DENKA BLACK (registered trade name) available from Denki Kagaku Kogyo K.K. and having an average particle diameter of 35 nm, a specific surface area of 69 $m^2/g$, an iodine adsorption amount of 93 mg/g and a bulk density of 0.25 g/ml as described above)

(Production of Semiconductive Roller)

The rubber composition thus prepared was fed into an extruder, and extruded into a tubular body having an outer diameter of 20 mm and an inner diameter of 7.0 mm. Then, the tubular body was fitted around a temporary crosslinking shaft, and crosslinked in a vulcanization can at 160° C. for 1 hour.

Subsequently, the crosslinked tubular body was removed from the temporary shaft, then fitted around a shaft having an outer diameter of 7.5 mm and an outer peripheral surface to which an electrically conductive thermosetting adhesive agent was applied, and heated in an oven at 160° C. Thus, the tubular body was bonded to the shaft. In turn, opposite end portions of the tubular body were cut, and the outer peripheral surface of the resulting tubular body was polished by a traverse polishing method by means of a cylindrical polishing machine and then mirror-polished as having an outer diameter of 20.00 mm (with a tolerance of 0.05) by a wet traverse polishing method with the use of a #2000 wrapping film (MIRROR FILM (registered trade name) available from Sankyo-Rikagaku Co., Ltd.) Thus, a semiconductive roller unified with the shaft was produced.

Subsequently, the polished outer peripheral surface of the semi conductive roller was rinsed with water, and the semiconductive roller was set in a UV irradiation apparatus (PL21-200 available from Sen Lights Corporation) with its outer peripheral surface spaced 10 cm from a UV lamp. Then, the semiconductive roller was rotated about the shaft by 90 degrees at each time, and each 90-degree angular range of the outer peripheral surface was irradiated with ultraviolet radiation at wavelengths of 184.9 nm and 253.7 nm for 5 minutes. For each 90-degree angular range of the outer peripheral surface, this operation was performed four times. Thus, an oxide film was formed in the outer peripheral surface. In this manner, the semiconductive roller was completed.

The outer peripheral surface of the semiconductive roller thus produced was observed at a magnification of 1000× by using a 50× objective lens and a Keyence's laser microscope VK-X100 in combination. As a result, the roughness profile of the outer peripheral surface had an arithmetic average roughness Ra of 0.43 μm and a section level difference Rδc of 0.68 μm as measured in conformity with Japanese Industrial Standards JIS B0601:2013.

Example 2

A semiconductive roller was produced in substantially the same manner as in Example 1, except that a #1000 wrapping film (MIRROR FILM (registered trade name) available from Sankyo-Rikagaku Co., Ltd.) was used as the abrasive material. The semiconductive roller had an arithmetic average roughness Ra and a section level difference Rδc shown in Table 2.

Comparative Example 1

A semiconductive roller was produced in substantially the same manner as in Example 1, except that #1000 water-resistant polishing paper was used as the abrasive material. The semiconductive roller had an arithmetic average roughness Ra and a section level difference Rδc shown in Table 2.

Comparative Example 2

A semiconductive roller was produced in substantially the same manner as in Example 1, except that #800 water-resistant polishing paper was used as the abrasive material. The semiconductive roller had an arithmetic average roughness Ra and a section level difference Rδc shown in Table 2.

Examples 3, 4, and Comparative Examples 3, 4

Semiconductive rollers were respectively produced in substantially the same manners as in Examples 1, 2 and Comparative Examples 1, 2, except that a BR (non-oil-extension type JSR BR01 available from JSR Co., Ltd. and having a cis-1,4 bond content of 95%) was blended instead of the SBR in the same proportion for the preparation of the rubber component. The semiconductive rollers each had an arithmetic average roughness Ra and a section level difference Rδc shown in Table 3.

<Actual Machine Test>

The semiconductive rollers produced in Examples and Comparative Examples were each incorporated in a new cartridge (integrally incorporating a toner container containing a toner, a photoreceptor body, and a developing roller kept in contact with the photoreceptor body) instead of the original developing roller for a commercially available laser printer. The laser printer utilized a positively-chargeable nonmagnetic single-component toner, and had a printing sheet number of 8000 recommended for the toner.

The new cartridge was mounted in the laser printer in an initial state, and a 5% density image was formed in a higher-temperature and higher-humidity environment at a temperature of 30±1° C. at a relative humidity of 80±1%. Then, the semiconductive roller was evaluated against fogging and background smudging based on the following criteria:

○: Fogging and background smudging were not observed in the image.

Δ: Slight fogging and background smudging which were invisible to naked eyes were observed in the image.

±: Fogging and background smudging which were visible to naked eyes were observed in the image.

<Toner Transportability>

The image formation was interrupted in the laser printer, and toner adhering to the surface of the developing roller was sucked to be removed by means of a suction-type portable charge meter Model 210 available from Trek Japan Co., Ltd., and an initial toner transport amount was determined based on the weight of the sucked toner and the area of the outer peripheral surface of the roller. A semiconductive roller having an initial toner transport amount of not less than 0.20 mg/cm$^2$ was rated as having excellent toner transportability.

The above results are shown in Tables 2 and 3. In Tables 2 and 3, "F" and "P" for the type of the abrasive material indicate the wrapping film and the water-resistant polishing paper, respectively.

TABLE 2

| Abrasive material | Example 1 | Example 2 | Comparative Example 1 | Comparative Example 2 |
|---|---|---|---|---|
| Type | F | F | P | P |
| #—Number | 2000 | 1000 | 1000 | 800 |
| Arithmetic average roughness Ra (μm) | 0.43 | 0.55 | 0.80 | 1.00 |
| Section level difference Rδc (μm) | 0.68 | 0.90 | 1.00 | 1.67 |
| Fogging and background smudging | ○ | ○ | x | x |
| Initial toner transport amount (mg/cm$^2$) | 0.20 | 0.32 | 0.75 | 0.87 |

TABLE 3

| Abrasive material | Example 3 | Example 4 | Comparative Example 3 | Comparative Example 4 |
|---|---|---|---|---|
| Type | F | F | P | P |
| #—Number | 2000 | 1000 | 1000 | 800 |
| Arithmetic average roughness Ra (μm) | 0.56 | 0.66 | 0.70 | 1.08 |
| Section level difference Rδc (μm) | 0.93 | 1.06 | 1.22 | 1.78 |
| Fogging and background smudging | ○ | Δ | x | x |
| Initial toner transport amount (mg/cm$^2$) | 0.24 | 0.41 | 0.87 | 0.93 |

The results for Examples and Comparative Examples in Tables 2 and 3 indicate that, where the outer peripheral surface of the semiconductive roller has a surface roughness profile such that the arithmetic average roughness Ra is not greater than 0.7 μm and the section level difference Rδc is not greater than 1.2 μm, the semiconductive roller has excellent toner transportability, and allows for formation of an excellent image free from fogging and background smudging.

This application corresponds to Japanese Patent Application No. 2014-150832 filed in the Japan Patent Office on Jul. 24, 2014, the disclosure of which is incorporated herein by reference in its entirety.

What is claimed is:

1. A semiconductive roller formed from a semiconductive rubber composition, the semiconductive roller comprising an outer peripheral surface having a surface roughness defined by a roughness profile such that an arithmetic average roughness is not greater than 0.7 μm and a profile section height difference Rδc between vertical section levels at a load length percentage Rmr1 of 25% and a load length percentage Rmr2 of 75% is not greater than 1.2 μm.

2. The semiconductive roller according to claim 1, wherein the semiconductive rubber composition comprises a particulate electrically-conductive carbon black.

3. The semiconductive roller according to claim 2, comprising an oxide film formed on the outer peripheral surface of the roller.

4. The semiconductive roller according to claim 1, comprising an oxide film formed on the outer peripheral surface of the roller.

* * * * *